United States Patent [19]

Nobuhiro

[11] 4,138,834

[45] Feb. 13, 1979

[54] PAPER SUPPLYING DEVICE IN COIN WRAPPING APPARATUS

[75] Inventor: Iizuka Nobuhiro, Himeji, Japan

[73] Assignee: Glory Kogyo Kabushiki Kaisha, Himeji, Japan

[21] Appl. No.: 810,819

[22] Filed: Jun. 28, 1977

[30] Foreign Application Priority Data

Jul. 2, 1976 [JP] Japan ..... 51-78544

[51] Int. Cl.[2] ..... B65B 11/04

[52] U.S. Cl. ..... 53/212; 83/564; 83/650; 133/1 A; 225/35; 225/93; 225/106; 242/55.3

[58] Field of Search ..... 83/564, 650; 225/93, 225/106, 34–36, 72–74; 133/1 R, 1 A; 53/212; 242/55.3, 55.42

[56] References Cited

U.S. PATENT DOCUMENTS

| | | | |
|---|---|---|---|
| 3,821,917 | 7/1974 | Hatanaka | 83/650 X |
| 3,899,864 | 8/1975 | Uchida et al. | 53/212 |
| 3,905,532 | 9/1975 | Eberly | 225/35 |
| 3,906,964 | 9/1975 | Ushio et al. | 133/1 A |
| 4,047,361 | 9/1977 | Ono et al. | 53/212 |

FOREIGN PATENT DOCUMENTS

| | | | |
|---|---|---|---|
| 1021247 | 11/1952 | France | 225/35 |

*Primary Examiner*—Frank T. Yost

*Attorney, Agent, or Firm*—Beveridge, DeGrandi, Kline & Lunsford

[57] ABSTRACT

In a paper supplying devide in a coin wrapping apparatus, different kinds of paper, each wound into a roll, are supported respectively on a corresponding number of paper supporting members mounted on paper carrying body. According to the kind of coins selected for wrapping in the coin wrapping apparatus, the paper carrying body is rotated to a position where a suitable kind of paper is supplied to a coin wrapping mechanism of the coin wrapping apparatus and cut into a predetermined length by a single cutting blade, which can be retracted from the path of the movement of the paper carrying body.

6 Claims, 5 Drawing Figures

PAPER SUPPLYING DEVICE IN COIN WRAPPING APPARATUS

BACKGROUND OF THE INVENTION

This invention relates generally to paper supplying devices in coin wrapping apparatuses and more particularly to a paper supplying device in a coin wrapping apparatus wherein several kinds of paper for wrapping respectively different kinds of coins are prepared beforehand, one kind thereof being selectively brought into a paper supplying position, and the paper is cut into a suitable length for wrapping the corresponding coins by a single cutter.

In coin wrapping apparatuses known heretofore, when the denomination (or the size) of coins is to be changed, it has been a common practice to prepare separately various kinds of paper and to selectively and manual insert one kind thereof adapted for a specific size of coins to be wrapped into the coin wrapping apparatus.

Such a procedure is found to be troublesome and inefficient because the existing paper must be removed and new paper must be inserted each time the size of the coins is changed, and any inadvertent neglect of replacement will result in defective wrapping of coins.

For overcoming the above described difficulty of the conventional coin wrapping apparatuses, there has been proposed a construction wherein a number of different kinds of paper, each wound into a roll, are beforehand prepared on a paper carrying body of a movable type, and one kind of paper suitable for the wrapping of a selected kind of coins is brought into the paper supplying position during the operation of the paper carrying body, wherefrom the paper is then delivered into a coin wrapping mechanism.

In this proposed construction of the coin wrapping apparatus, however, a cutter for cutting the paper into a desired length has been provided on the paper carrying body at a position confronting each of the aforementioned paper rolls, and hence a number of cutters corresponding to the number of the paper rolls have been required, giving rise to disadvantageous features such as complication of the construction of the apparatus and consumption of much labor and cost in manufacture.

It has been of course apparent that the employment of a single cutter for cutting different kinds of paper is preferable. However, the mere provision of a single cutter stationarily in an intermediate position between the paper supplying position of the paper carrying body and the coin wrapping mechanism of the coin wrapping apparatus has caused, after a coin wrapping operation, the leading end of the wrapping paper to be used for the succeeding wrapping to be located nearby the cutter or to be somewhat advanced therefrom toward the coin wrapping mechanism. Then, if the paper carrying body is moved in this state for changing the kind of the paper in accordance with the coin size, the leading end of the paper will tend to be caught by the stationary parts of the coin wrapping mechanism. This will give rise to disadvantageous features such as damaging of the leading part of the paper or jamming of the coin wrapping mechanism by the broken end of the paper.

SUMMARY OF THE INVENTION

With the above described difficulties of the conventional apparatuses in view, a primary object of the present invention is to provide a paper supplying device in a coin wrapping apparatus, wherein a single cutting blade is provided for cutting various kinds of the wrapping paper, and the cutting blade is, at the time of coin wrapping operation, placed in the path of the movement of the paper carrying body.

Another specific object of the invention is to provide a paper supplying device for a coin wrapping apparatus, wherein the possibility of damaging the leading part of the wrapping paper or jamming the operation of the succeeding mechanism is substantially eliminated regardless of the use of the single cuttiing blade.

These objects and other objects which are made apparent in the detailed description set forth hereinlater can be achieved by a paper supplying device in a coin wrapping apparatus, comprising a movable paper carrying body and a plurality of paper supporting members provided on the paper carrying body, each of the paper supporting members supporting a specific kind of paper wound into a roll and adapted for wrapping a corresponding specific kind of coins, the paper carrying body being movable for bringing a selected one of said paper supporting members into a paper supplying position facing the coin wrapping mechanism of the coin wrapping apparatus, the paper supplying device being characterized by the improvement wherein a single cutting blade at the paper supplying position is retractable from an operative position located the path of movement of the paper carrying body when the paper carrying body is moved to bring another paper supporting member to the paper supplying position.

The nature, principle, and utility of the present invention will be more clearly understood from following detailed description of the invention when read in conjunction with the accompanying drawing, wherein like parts are designated by like reference numerals.

DETAILED DESCRIPTION

Figure 1:
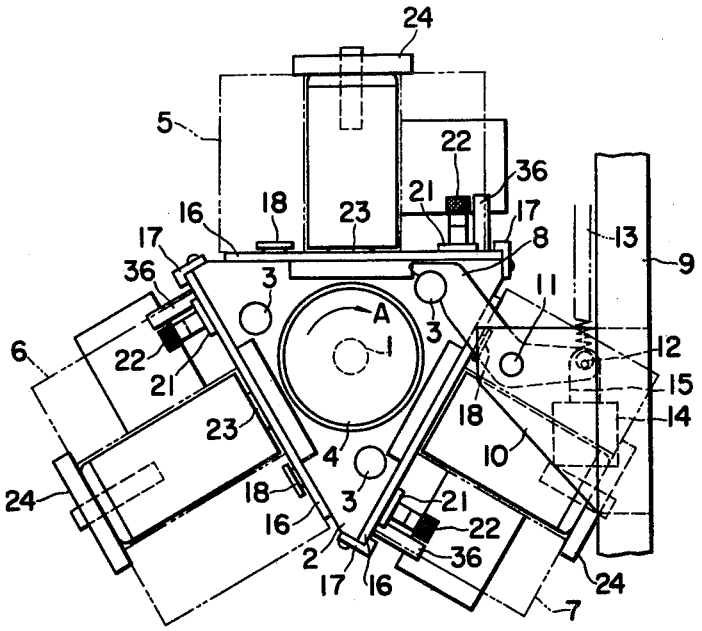
FIG. 1 is an elevational view of an example of a paper supplying device in a coin wrapping apparatus, constituting an embodiment of the present invention.
Figure 2:
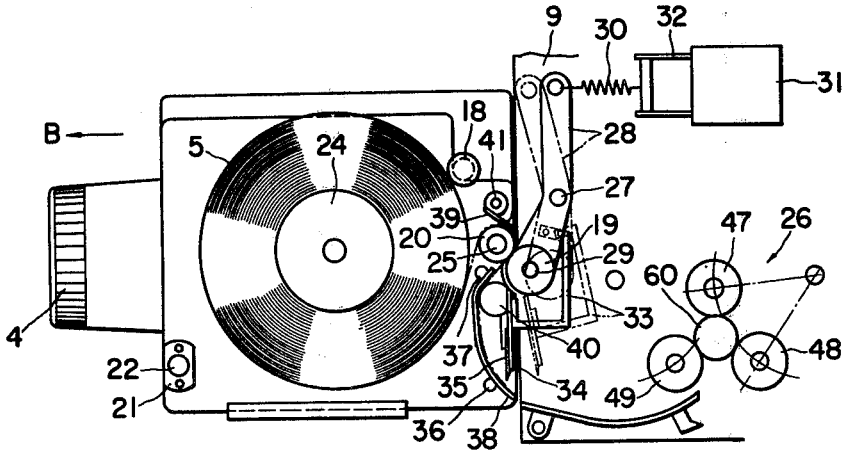
FIG. 2 is a plan view of the same device.

Referring to FIGS. 1 and 2, the paper supplying device illustrated therein has a paper carrier 2 of a substantially triangular cross-sectional shape, rotatably supported by a shaft 1 in a coin wrapping apparatus. An engaging pin 3 is provided on each corner of the triangular paper carrier 2 which can be rotated by means of a knob 4 in the direction of arrow A to position a selected one of paper rolls 5, 6, and 7 carried on the paper carrier 2 at a paper supplying position.

A lever 8 to be operatively engaged at one end thereof with a corresponding engaging pin 3 is provided swingably around a stationary shaft 11 provided on a bracket 10 secured to a structural member 9 of the apparatus. The other end of the lever 8 is connected through a pin 12 with a spring 13 which urges the lever 8 swing around the shaft 11 so that the other end thereby is forced into engagement with the pin 3. The connecting pin 12 at one end of the lever 8 is further connected to a plunger 15 of an electromagnet 14 which, when energized, pulls the first end of the holding lever 8 away from the engaging pin 3. After the disengagement of the holding lever 8 from the engaging pin 3, a mechanism not shown restricts the rotation of the paper carrier 2 to a predetermined extent.

On each side surface of the paper carrier 2, a paper supporting plate 16 is detachably mounted. The plate 16 is inserted between a guide plate 17 secured to the carrier 2 and the side surface thereof whereby the supporting plate 16 is maintained in tight contact with the side surface. On each side surface of the carrier 2, a positioning piece 18 is further provided at a position to abut against a notched part of the paper supporting plate 16. This piece 18 prevents the paper supporting plate 16 from being displaced when the paper is supplied from the paper carrier 2 to the coin wrapping mechanism of the coin wrapping apparatus as will be described hereinlater in more detail.

Furthermore, a positioning plug 22 is provided at each side surface of the carrier 2 to pass through a positioning part 21 of the paper supporting plate 16 into a hole not shown in the paper carrier 2 when the plate 16 is brought into its normal position.

In the case where the paper supporting plate 16 is to be dismounted from the paper carrier 2, the plug 22 is first pulled out of the hole, and then the paper supporting plate 16 can be removed from the paper carrier 2 in the direction of arrow B in FIG. 2.

At the central parts of the paper supporting plates 16, there are provided paper supporting bobbins 23. The aforementioned paper rolls 5, 6, and 7 are supported around the paper supporting bobbins 23 and are held in their positions by paper holding members 24. Furthermore, a roller 20 is rotatably mounted on a shaft 25 provided on each of the paper supporting plates 16 at a position facing the coin wrapping mechanism 26.

A lever 28 swingably supported around a pivotal point 27 on the structural member 9 of the apparatus has at one end thereof, a paper feeding roller 19 mounted rotatably around a shaft 29 projecting from that end of the lever 28. The other end of the lever 28 is connected through a spring 30 to a plunger 32 of an electromagnet 31. Upon energization of the electromagnet 31, the lever 28 is rotated clockwise around the pivotal point 27 thereby bringing the paper feeding roller 19 provided at the first end of the lever 28 into abutment against the aforementioned roller 20 provided on the paper supporting plate 16.

At one end of a branched member 33 secured to a middle part of the lever 28, a cutting blade 35 mounted on a mounting plate 34 is provided. The drive means for cutting blade 35 is thus provided by the solenoid 31, lever 28 and member 33. The cutting blade is retracted in accordance with the rotating direction of the lever 28 away from the path of movement of the paper carrier 2 during the paper changing operation of the paper supplying device and then moved to an operative position at the paper supplying position of the selected one of the paper supporting plates 16 during the paper feeding operation of the paper supplying device.

A guide plate 38 supported by supporting pins 36 and 37 on the paper supporting plate 16 guides the paper sent out of the paper roll. A stationary plate guides the paper in a curved path from the paper supplying station to the coin wrapping mechanism 26. Blade 35 faces the concave side of this curved path so that the paper will be cut when it is drawn tight toward a straightened position by the coin wrapping mechanism. A paper holding member 39 swingable around a pivotal shaft 41 fixed to the paper supporting plate 16 is urged by a spring (not shown) toward the roller 20, and the paper passing around the roller 20 is depressed by the member 39 so that any possibility of creating a slack in the paper passing around the roller 20 is thereby eliminated. Furthermore, a paper holding bar 40 having an arcuate circumferential surface is provided on the paper supporting plate 16 to confront the guide plate 38 so that the paper passing therebetween is held between the bar 40 and the guide plate 38.

When the wrapping paper in the form of rolls is to be loaded on the paper carrier 2, the paper supporting plates 16 are preferably removed temporarily out of the paper carrier, and the paper rolls are loaded around the paper supporting bobbins 23 with each leading end of the paper passed between the roller 20 and the paper holding member 39 and further between the guide plate 38 and the paper holding bar 40.

Figure 3:
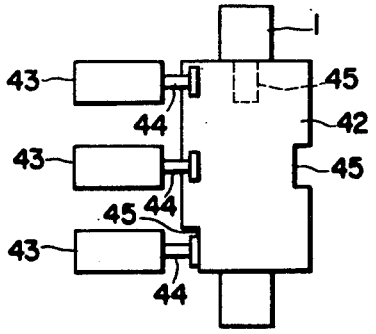
FIG. 3 is an elevational view of operating parts of selecting switches.

On the rotating shaft 1 of the paper carrier 2, a switch-operating cam 42 is provided. The operating parts 44 of selectively operable switches 43 are brought into contact with the cam 42 as shown in FIG. 3. Recessed portions 45 for opening the switches 43 are provided along the circumferential surface of the cam 42 in an angularly displaced manner.

Figure 4:
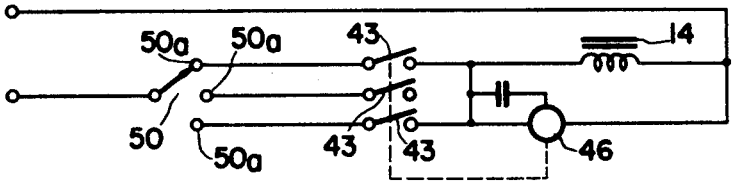
FIG. 4 is an electrical circuit diagram of the selecting switches.

The switches 43 connected mutually in parallel are further connected in a circuit of an electric motor 46 for driving the paper carrier 2 and an electromagnet 14 as shown in FIG. 4. Upon energization of the electromagnet 14, the holding lever 8 now in engagement with one of the pins 3 on the paper carrier 2 is swung around the fixed shaft 11 in a direction to be disengaged from the pin 3, and the paper carrier 2 is placed in a freely rotatable state.

The coin wrapping mechanism 26 comprises a plurality of coin wrapping rollers 47, 48, and 49. A stack 60 of coins is rotated centrally between these rollers 47, 48, 49 and wrapped by the paper fed from the paper supplying device.

The example of the paper supplying device of the above described construction according to this invention operates in the following manner.

A denomination of coins is first set in the coin wrapping apparatus by manually rotating a denomination setting knob. Thus, the width of the coin passage, through which coins are successively delivered to be counted, and the heights of the levers for crimp-folding the wrapping paper on opposite ends of the coin stack are both readjusted for a newly selected kind of coins, and simultaneously the movable contact of a rotary type transfer switch 50 is rotated. The stationary contacts **50*a* of the transfer switch 50 are connected respectively with the selectively operable switches 43 as shown in FIG. 4. As a result, the electric motor 46 and the electromagnet 14 are both energized through one of the contacts 50*a* corresponding to the now selected kind of coins and a switch 43 now kept in the closed state in accordance with the angular position of the rotating shaft 1**.

Energization of the electromagnet 14 causes the holding lever 8 to rotate in the direction for its disengagement from the pin 3, and the energization of the electric motor 46 rotates the shaft 1 supporting the paper carrier 2. The rotation of the shaft 1 causes rotation of the cam 42 thereby operating the switches 43 sequentially. When one of the switches 43, through which the circuit for energizing the electric motor 46 and the electromagnet 14 is established, is opened as a result of the operating part 44 of the switch 43 falling into a recessed portion 45, the operation of the electric motor 46 is terminated and the electromagnet 14 is deenergized. The holding lever 8 is thus brought into engagement with the pin 3 thereby holding the paper carrier 2 in the stopped position.

At an instant when a stack 60 of a predetermined number of coins is received in the coin wrapping mechanism 26, the electromagnet 31 is energized to rotate the lever 28 in the clockwise direction as viewed in FIG. 2. The paper feeding roller 19 rotatably mounted on the lever 28 is thus forced into contact with the roller 20. Since the paper feeding roller 19 is driven intermittently by an electric motor (not shown) provided in the coin wrapping mechanism 26, a coin wrapping paper of a suitable kind is fed into the coin wrapping mechanism 26 with proper timing.

Simultaneous with the shifting of the paper feeding roller 19 toward the roller 20, the cutting blade 35, which has been retracted from the path of movement of the paper carrier 2, is advanced to the paper supplying position confronting the guide plate 38. In accordance with the rotation of the paper feeding roller 19, the paper sent between the paper feeding roller 19 and the driven roller 20 is fed to the cylindrical surface of the stacked coins 60 being rotated in the coin wrapping mechanism 26.

At the instant when the coin wrapping paper starts to be wound around the stacked coins, the paper is tensioned abruptly and part thereof to become the trailing end of a wrapping piece is cut by the cutting blade 35, thereby providing the wrapping piece of a predetermined length of the wrapping paper. It should the noted that the trailing end of the wrapping piece of paper is cut in the form of a concave V shape, and therefore the leading end of the wrapping piece of paper is formed into a convex V shape. After the delivery of this piece of the predetermined length of the paper, the electric motor 46 stops its operation, and the paper now wrapped around the coin stack 60 is folded and crimped at the lateral edges thereof extending beyond the upper and lower ends of the coin stack 60, thus completing the wrapping operation of the coins.

When the setting of the coin wrapping apparatus is to be changed to another denomination of coins, the switch 50 is switched to another corresponding position in a manner interlinked with the change in the setting, and the corresponding one of the selectively operable switches 43 is connected to the power source. When the switch 43 is operated in accordance with the angular position of the paper carrier 2, the electric motor 46 and the electromagnet 14 which operates the holding lever 8 are both energized. As a result, the holding lever 8 is disengaged from the pin 3, and the paper carrier 2 is rotated by the electric motor 46.

When the paper carrier 2 is rotated to a position, the paper of the kind suitable for the selected coin denomination is brought into the paper supplying position facing the coin wrapping apparatus, the switch 43 selectively connected to the power source by the switch 50 is opened, and the electric motor 46 and the electromagnet 14 are both deenergized. Thus, the rotation of the paper carrier 2 is terminated at that position, and the paper of selected kind is supplied through the paper supplying position to the coin wrapping mechanism 26. Also, interrelatedly with the operation of the coin wrapping apparatus, the electromagnet 31 is operated thereby to rotate the lever 28, causing the cutting blade 35 until now retracted from the path of movement of the paper carrier 2 to be advanced to a position near the paper supplying position of the paper supporting plate 16 under operation.

In the above described embodiment of the invention, the cutting blade 35 moved by the electromagnet 31 toward or away from the paper supplying position has been so constructed that the blade 35 advances toward the position when the same electromagnet 31 is energized in accordance with the operation of the coin wrapping apparatus. However, the cutting blade 35 may otherwise be so arranged that it is advanced when the electromagnet 31 is deenergized in relation with the operation of the coin wrapping apparatus. Furthermore, the device of the invention may otherwise be so constructed that the electromagnet 31 is energized in accordance with the operation of the transfer switch 50, thus advancing the cutting blade 35 to the operating position, and that the electromagnet 14 which disengages the holding lever 8 from the pin 3 and the electric motor 46 which rotates the paper carrier 2 are both energized in relation to the retraction of the cutting blade 35.

Alternatively, the invention may be so constructed that a cam is further provided on the paper carrier 2, and the lever 28 is operated by the cam at the time of the rotation of the paper carrier 2 in the direction to retract the cutting blade 35 from the path of movement of the paper carrier 2.

Figure 5:
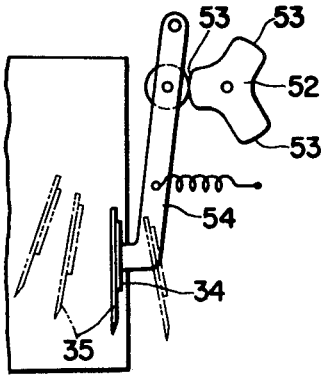
FIG. 5 is a plan view showing a part including a cutting blade of another embodiment of the invention.

As a further modification of the afore described embodiment of the invention, the cutting blade 35 may be driven by an electric motor. In this case, a plurality of projections 53 are provided on a cam 52 driven by the electric motor, as shown in FIG. 5. The projections 53 are selectively engaged with a lever 54 provided separately from the lever 28 and provided at one end thereof with a cutting blade 35, whereby the advanced distance of the cutting blade 35 and therefore the length of the wrapping paper can be thereby regulated. This construction sets the blade 35 at different operative positions which are changed when the paper carrying body is moved to change the paper supporting body at the paper supplying position. This is suitable for those coin wrapping apparatuses wherein various kinds of coins having a wide difference in their diameters are to be wrapped with the wrapping paper.

Alternatively, the paper carrier 2 may be adapted to be rotatable also manually by means of the knob 4, or the paper cut by a tension caused therein at the time when the paper is caught between the coin wrapping rollers 47, 48 and 49 and the coin stack may be otherwise the cut by a tension caused by an additionally provided tension roller disposed between the coin wrapping mechanism 26 and the cutting blade 35.

I claim:

1. In a paper supplying device in a coin wrapping apparatus, comprising a movable paper carrying body and a plurality of paper supporting members provided on said paper carrying body, each of the paper supporting members supporting a specific kind of paper wound into a roll and adapted for wrapping a corresponding kind of coins, said paper carrying body being movable for bringing the paper supporting member corresponding to a selected kind of coins into a paper supplying position facing a coin wrapping mechanism of the coin wrapping apparatus, the improvement wherein a single cutting blade is provided in opposition to said paper supplying position and operates to cut a length of the paper for wrapping coins, said cutting blade being movable from an operative position located in the path of movement of the paper carrying body to a retracted position spaced from the path of movement of the paper carrying body, and means for moving said cutting blade to the retracted position when said paper carrying body is moved, said device having means for guiding the paper in a curved path from a roll on a paper supporting member at the paper supplying station to the coin wrapping mechanism, said cutting blade while in its operative position facing the concave side of said curved path whereby the paper will be cut when it is drawn toward a straightened position between the paper supplying device and the coin wrapping mechanism.

2. The paper supplying device of claim 1 in combination with a coin wrapping mechanism located at said paper supplying station, said coin wrapping mechanism having means for rotatably supporting a stack of coins to wrap a paper thereabout.

3. In a paper supplying device in a coin wrapping apparatus, comprising a movable paper carrying body and a plurality of paper supporting members provided on said paper carrying body, each of the paper supporting members supporting a specific kind of paper wound into a roll and adapted for wrapping a corresponding kind of coins, said paper carrying body being movable for bringing the paper supporting member corresponding to a selected kind of coins into a paper supplying position facing a coin wrapping mechanism of the coin wrapping apparatus, the improvement wherein a single cutting blade is provided in opposition to said paper supplying position and operates to cut a length of the paper for wrapping coins, said cutting blade being movable from an operative position located in the path of movement of the paper carrying body to a retracted position spaced from the path of movement of the paper carrying body, and means for moving said cutting blade to the retracted position when said paper carrying body is moved, said device having means for positioning said cutting blade at different operative positions to cut different lengths of paper corresponding to the selected kind of coins being wrapped, said positioning means being operable to change the operative position of the cutting blade when the paper supporting body at the paper supplying position is changed.

4. In a paper supplying device for use in a coin wrapping apparatus, comprising a horizontal shaft supported so as to be selectively rotated, a movable wrapping paper-roll carrier provided so as to be selectively moved by rotation of said horizontal shaft in accordance with kind of coins to be processed and thereby to selectively transfer said wrapping paper-rolls so that one corresponding to a selected kind of coins is brought to a position near the coin wrapping mechanism and adapted for feeding a paper toward said coin wrapping mechanism, and a plurality of paper-roll supporting members provided on said paper-roll carrier, each of said paper-roll supporting members supporting thereon respective wrapping paper rolls so that the winding axis of each paper-roll crosses said horizontal shaft for selectively transferring said wrapping paper-rolls; an improvement, wherein a single cutting blade is provided at the position facing the coin wrapping mechanism, said cutting blade being adapted for cutting the paper fed from the wrapping paper-roll brought to said selected position into a predetermined length; a swingable lever coupled with said cutting blade, driving means for moving said lever to retract said cutting blade from the path of movement of the wrapping paper-roll carrier during the paper-roll changing operation of said paper-roll carrier and to extend said cutting blade to an operative position lying in said path of movement of the wrapping paper-roll carrier upon selection of a wrapping paper-roll supporting member so as to bring a selected wrapping paper-roll corresponding to selected coin kind at the paper supplying position.

5. A paper supplying device as claimed in claim 4 in which said driving means comprises a branched member supported by the swingable lever and an electromagnet which is energized in accordance with setting of the coin wrapping apparatus with respect to a selected kind of coins, said swingable lever being swung in a direction for bringing said single cutting blade into its operative position by said electromagnet through said branched member.

6. A paper supplying device as claimed in claim 4, in which said cutting blade is mounted on one distal end of the swingable lever so as to be displaced a distance for a selected kind of coins.

* * * * *